United States Patent [19]

Barthel

[11] Patent Number: 4,717,267

[45] Date of Patent: Jan. 5, 1988

[54] ARRANGEMENT IN AN ADJUSTABLE ROLLER BEARING FOR LATERAL GUIDANCE OF RUNNING WEBS

[75] Inventor: Sven Barthel, Nesbru, Norway

[73] Assignee: Thune-Eureka A/S, Tranby, Norway

[21] Appl. No.: 875,238

[22] Filed: Jun. 16, 1986

[30] Foreign Application Priority Data

Jun. 21, 1985 [NO] Norway ..... 852521

[51] Int. Cl.[4] ..... F16C 23/00; F16C 25/08

[52] U.S. Cl. ..... 384/247; 384/38; 384/42

[58] Field of Search ..... 384/10, 38, 42, 50, 384/54, 55, 57, 58, 59, 247, 252, 260

[56] References Cited

U.S. PATENT DOCUMENTS

| | | | |
|---|---|---|---|
| 1,798,257 | 3/1931 | Hansen | 384/42 |
| 2,452,804 | 11/1948 | Sulprizio | 384/42 |
| 3,291,542 | 12/1966 | North | 384/55 |
| 3,719,404 | 3/1973 | Sterner | 384/38 |
| 4,068,906 | 1/1978 | Dur et al. | 384/54 |

FOREIGN PATENT DOCUMENTS

| | | |
|---|---|---|
| 120104 | 8/1970 | Norway . |
| 229107 | 10/1968 | U.S.S.R. . |

*Primary Examiner*—David Werner

*Attorney, Agent, or Firm*—Young & Thompson

[57] ABSTRACT

An adjustable roller bearing for lateral guidance of travelling webs, e.g. a paper wire, comprises a bearing casing that is slidably mounted in a bearing foundation by the aid of members projecting diametrically from the bearing casing and bearing foundation and being in engagement with each other as well as encased by in hydraulic or pneumatic bellows which act to displace the bearing casing. The projecting members are provided with cooperating guide grooves and rollers respectively. The guide grooves are diametrically outside the contact faces of their associated roller, and have faces which in cross section follow a circular curve having the roller center as its center. Between each of these faces and the adjacent roller contact face there is a lining one end of which is adapted to the circular shape, whereas the other side, facing the roller contact face, is planar and forms a contact face for the corresponding roller.

4 Claims, 5 Drawing Figures

ARRANGEMENT IN AN ADJUSTABLE ROLLER BEARING FOR LATERAL GUIDANCE OF RUNNING WEBS

The present invention relates to an arrangement in an adjustable roller bearing for lateral guidance of traveling webs, e.g. a paper wire in a paper machine, said roller bearing comprising a bearing casing that is slidably mounted in a bearing foundation by the aid of members projecting diametrically from said bearing casing and bearing foundation, being in engagement with each other and being encased in hydraulic or pneumatic bellows means acting as displacement means for the bearing casing, said projecting members being provided with cooperating lateral grooves and rollers respectively.

Such an adjustable roller bearing for lateral guidance of running webs is known from NO-PS No. 120 104. An adjustable roller bearing of this kind has a compact and sturdy design, comprises displacement bearings (roller-guide grooves) showing low friction, and provides a positive and linear guide movement. The movable parts of said roller bearing are provided inside said bellows means completely protected against external influence.

The bearing casing and the bearing foundation with associated members are usually made from cast steel. When such adjustable bearings were used it was found that the rollers cause wear of the cast steel in the guide grooves cooperating with said rollers due to incident moment loads. It is an object of the invention to provide linings, e.g. manufactured from spring steel, between said rollers and cooperating groove faces, designed in such a manner that moment loads are balanced and the wear is reduced.

According to the invention an arrangement in an adjustable roller bearing of the kind mentioned above is thus proposed, said arrangement being characterized by the fact that said guide grooves are formed diametrically outside the contact surface of associated rollers which grooves in cross section conform to circular curves having the roller center as their center and by the fact that between each each of these faces and the adjacent roller contact face a lining is provided one side of which is adapted to said circular curve shape, whereas its other side facing the roller contact face is planar and forms a contact face for the roller.

In case of moment loads said linings will be able to move a little, i.e. carry out a rotary motion as seen in cross section. Thus, the moment load is balanced and wear is considerably reduced.

The two linings in each guide groove may suitably be connected to each other. In an especially advantageous embodiment said two linings in each guide groove are provided as parts of an integral body. By using such an integral lining body in each guide groove the entire guide groove cross section may advantageously follow a circular curve, said integral body being provided with a corresponding outer surface.

Said linings are preferably kept in place by resilient means so that said linings are able to carry out the desired minor swinging/rotary motions.

Figure 1:
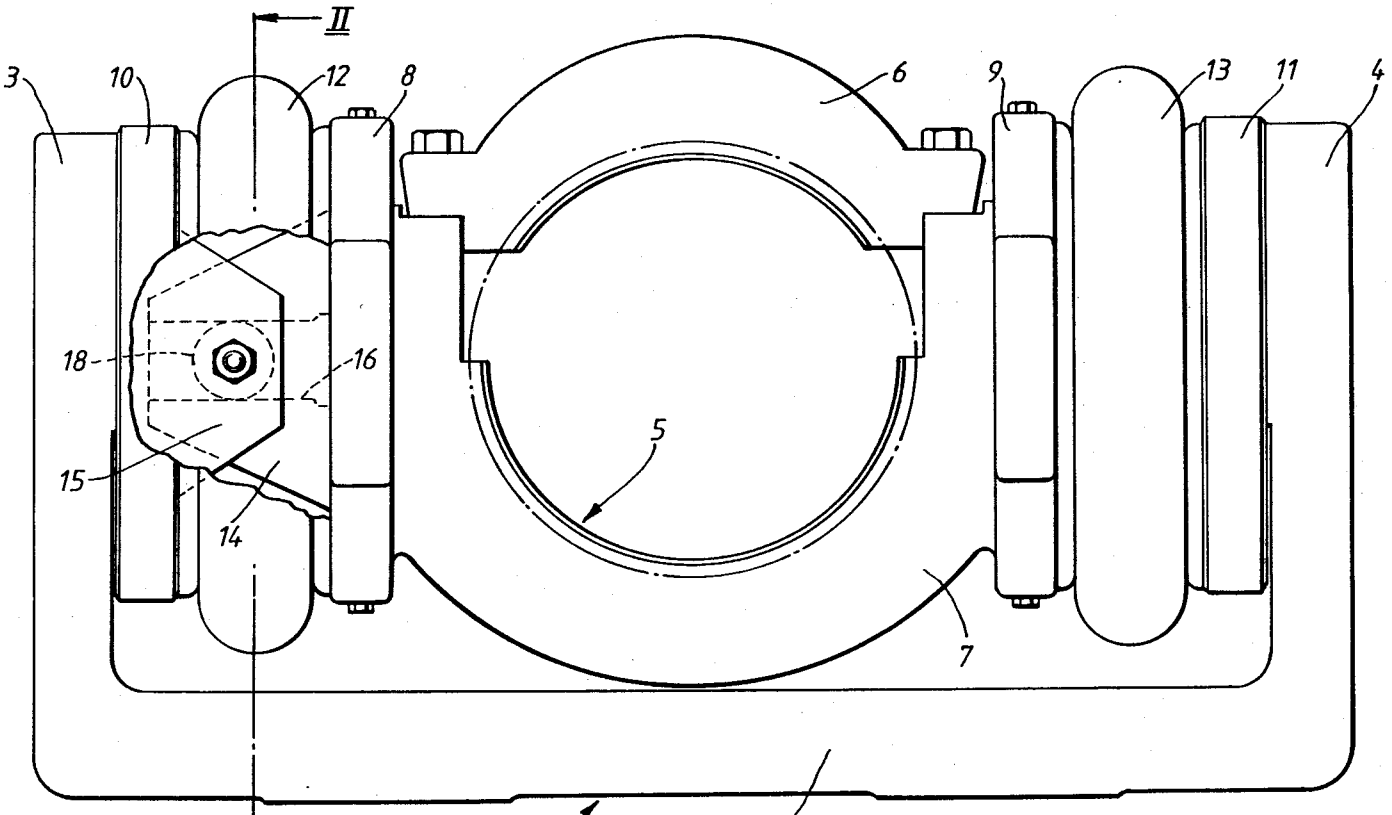
Figure 2:
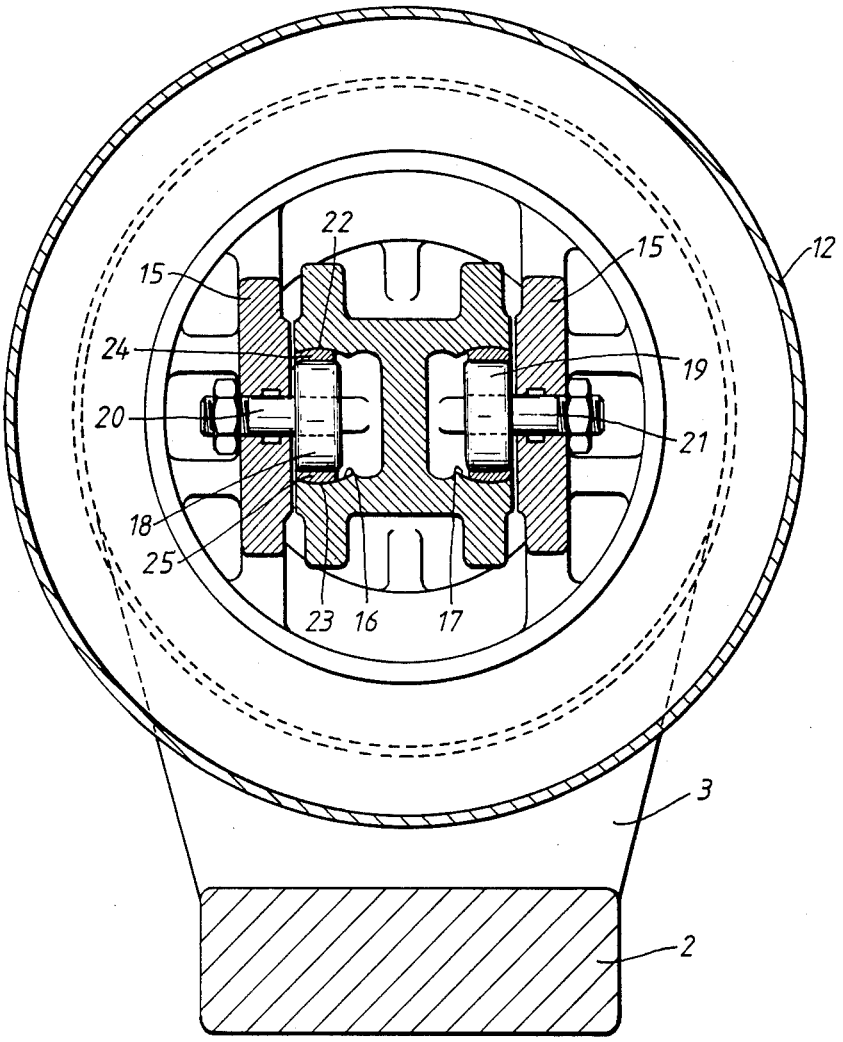
Figure 3:
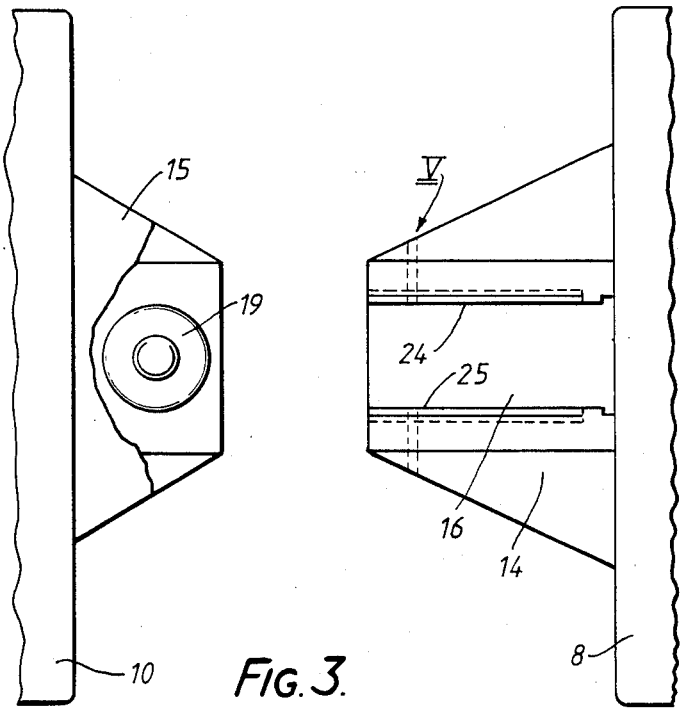
Figure 4:
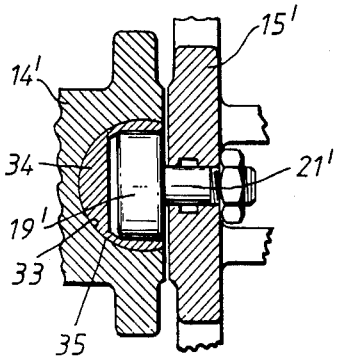
Figure 5:
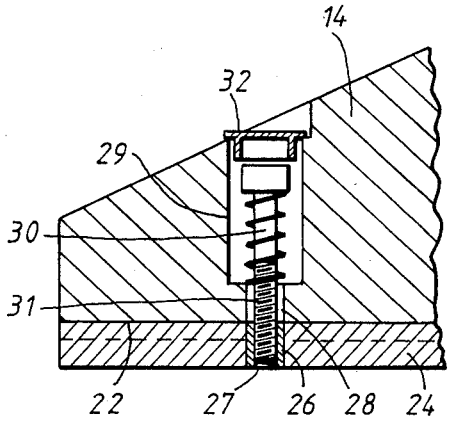

The invention will now be disclosed in more detail with reference to the accompanying drawings, where FIG. 1 is a plan view of an adjustable roller bearing according to the invention, FIG. 2 is a sectional view taken along line II—II in FIG. 1 and shown on a larger scale, FIG. 3 is a plan view where the bearing casing and the bearing foundation, respectively, which engage with one another are shown spread apart on the same scale as FIG. 2, FIG. 4 shows a variant of a section of the invention, and FIG. 5 shows an enlarged part of the area designed V in FIG. 3.

The adjustable roller bearing shown in FIG. 1 mainly comprises a bearing foundation 1 consisting of a base 2 from which rise supporting members 3 and 4. Furthermore, the roller bearing comprises a bearing casing 5. Said bearing casing 5 is composed of a lower shell 7 and an upper shell 6 which together form a spherical casing of a top bearing provided on the roller top not shown.

Lower shell 7 is at each side provided with a flange 8,9 respectively. The bearing foundation is provided with corresponding flanges 10,11 respectively, on its supporting members 3,4. Between the flanges 8,10 and 9,11, respectively, facing each other a bellows means 12, 13 is clamped. Each bellows means 12, 13 is connected to a pressure fluid source in a manner not shown. Reference is made to the above mentioned NO-PS No. 120 104 showing details of clamping bellows means between the flanges.

A projection 14 extends from flange 8. Another projection 15 extends from flange 10. Said projections 14,15 engage each other, see FIGS. 2 and 3, and projection 14 is provided with two guide grooves 16,17, whereas the fork shaped projection 15 is provided with two rollers 18,19. Each roller 18,19 is mounted on projection 15 by the aid of a bolt 20,21.

As will appear especially from FIG. 2, guide groove 16 has faces 22, 23 that are curved in cross section. The curvature follows circular curves having the center in the center of roller 18. Between roller 18 and the faces 22, 23 of guide groove 16, extending diametrically outside said roller, a lining 24, 25 is provided. Each of said linings 24,25 is an elongated, i.e. strip shaped, member one side of which is curved in correspondence with the curvature of the contacting face 22, 23 of groove 16, whereas the other side is planar and forms a contact face for roller 18.

Each lining 24, 25 of this kind is clamped by the aid of a resilient clamping connection. An example of such a connection is shown in FIG. 5. In lining 24 a threaded bore 26 is provided and a threaded sleeve 27 is threaded into said bore. In projection 14 a bore 28 is provided, which forms an extension of an expanded bore 29. A screw 30 is threaded into sleeve 27 and a helical spring 31 is provided between the head of said screw 30 and the annular bottom of bore 29. Bore 28 has a larger diameter than screw 30. This clamping connection thus permits a certain degree of movement between projection 14 and lining 24. Bore 29 is closed by a plastic plug 32. Lining 25 is mounted accordingly.

Groove 17 is provided with corresponding linings for cooperation with roller 19. In FIG. 1 projections 14,15 are shown on only one side of the bearing. Corresponding projections with associated guide grooves and rollers are obviously provided on the other side of the bearing, inside bellows means 13, as well.

Instead of two separate linings, such as linings 24, 25, the linings may obviously be constructed as parts of an integral body. Such a possible embodiment is shown in FIG. 4. The same reference numbers are used for corresponding parts, said reference numbers being marked. Guide groove 33 is here formed in projection 14' with a full guide face cross section, i.e. the guide groove cross section follows a circular curve on its entire extension. Correspondingly, lining 34 is formed with a corresponding outside face 35. Lining 33 is thus constructed as a homogeneous body, showing an approximately U-shaped cross section with roller 19' entering the U-shape, as shown in FIG. 4.

Generally, casting steel is used for manufacturing the bearing casing and bearing foundation, as well as for the projections on said components. In this connection it will be advantageous to use spring steel for manufacturing the linings. It will be understood that the faces having a circular arc-shaped cross section in the guide grooves may be machined in a simple manner and the same goes for the curved face on the lining.

Having described my invention, I claim:

1. In an adjustable roller bearing for lateral guidance of travelling webs, said roller bearing comprising a base having a pair of diametrically disposed guide members extending toward one another, a bearing casing slidably mounted in said base between said guide members by means of a pair of projections each received by a respective said guide member, each said projection being guided in its respective said guide member by a pair of coaxial rollers received in a pair of parallel guide grooves, each said guide groove having a pair of parallel faces straddling its respective said roller, and a hydraulic or pneumatic bellows encasing each said guide member and its corresponding said projection; the improvement in which each of said pair of faces of each said groove has a concave, semi-cylindrical shape generated about an axis perpendicular to and intersecting the axis of its respective said roller, each said face being provided with a lining having a matching convex semi-cylindrical surface contacting said face and a planar surface adapted to contact the corresponding said roller.

2. Roller bearing according to claim 1, wherein each said pair of guide grooves together form a continuous semi-cylindrical surface, said linings for each said pair of guide grooves being interconnected.

3. Roller bearing according to claim 2, wherein said linings for each said pair of guide grooves are integrally formed.

4. Roller bearing according to claim 1, wherein each said lining is maintained in its corresponding said face by resilient means.

* * * * *